US008739967B1

(12) United States Patent
George

(10) Patent No.: US 8,739,967 B1
(45) Date of Patent: Jun. 3, 2014

(54) CIGARETTE STORAGE SYSTEM

(76) Inventor: Edythe George, Kalamzoo, MI (US)

( * ) Notice: Subject to any disclaimer, the term of this patent is extended or adjusted under 35 U.S.C. 154(b) by 59 days.

(21) Appl. No.: 13/468,360

(22) Filed: May 10, 2012

Related U.S. Application Data

(60) Provisional application No. 61/518,872, filed on May 11, 2011.

(51) Int. Cl.
*A24F 15/18* (2006.01)

(52) U.S. Cl.
USPC ..... 206/86; 206/242; 206/256; 206/265; 131/242; 131/329

(58) Field of Classification Search
USPC ..... 206/85–95, 242–276
See application file for complete search history.

(56) References Cited

U.S. PATENT DOCUMENTS 4,583,939 A * 4/1986 Brickwedde ..... 431/253
4,789,059 A 12/1988 Kim
5,323,364 A * 6/1994 Hayashi et al. ..... 368/276
2003/0063523 A1* 4/2003 Mulaw ..... 368/10
2004/0216753 A1* 11/2004 Fox ..... 131/242
2005/0051183 A1* 3/2005 Coulthard ..... 131/256
2005/0130090 A1 6/2005 Santoro
2007/0108091 A1* 5/2007 Stewart ..... 206/581
2011/0017762 A1* 1/2011 Emmett et al. ..... 221/1

FOREIGN PATENT DOCUMENTS

WO WO 01/56411 * 8/2001

* cited by examiner

*Primary Examiner* — Philip Tucker
*Assistant Examiner* — Eric Yaary
(74) *Attorney, Agent, or Firm* — Emery L. Tracy; Ruth Eure

(57) ABSTRACT

A cigarette storage system for holding at least one cigarette is provided. The cigarette storage system comprises a case and an airtight storage formed in the case for holding the at least one cigarette. A lighter fluid reservoir is formed in the case with the lighter fluid reservoir having an amount of lighter fluid therein. A cigarette lighter fluidly cooperates with the lighter fluid in the lighter fluid reservoir with the cigarette lighter igniting the lighter fluid to produce a flame for lighting the at least one cigarette wherein a user can remove a cigarette from the airtight storage and ignite the cigarette with the cigarette lighter prior to smoking the cigarette.

17 Claims, 1 Drawing Sheet

10
Cigarette Snuffer
16
Lighter ON/OFF Switch
14
Lighter Fluid Refill
Ignitor Flame
30
Sliding Door
For Finger
Odour Elimination
12
28
Compartment for Gums or Mints
18

10
Cologne \ Perfume Refill
26
12
20
Lighter ON/OFF Switch
14
Ejection Point for Cologne
or Perfume
22
Spray Button for Cologne
24

CIGARETTE STORAGE SYSTEM

The present application claims the benefit of priority of provisional patent application Ser. No. 61/518,872, filed on May 11, 2011, entitled "Cigarette Case".

BACKGROUND OF THE INVENTION

1. Field of the Invention

This invention relates generally to a cigarette storage system and, more particularly, the invention relates to a cigarette storage system incorporating airtight storage for six or seven cigarettes, a cigarette lighter, a snuffer for extinguishing a lit cigarette, a locking compartment for gum or breath mints, and a reservoir and spray dispenser for perfume or cologne.

2. Description of the Prior Art

Many Americans smoke cigarettes and must now go through great lengths in order to enjoy a simple smoke. These days, smokers can't smoke in an office, in a restaurant, in an airport or bus terminal or on a plane or bus; in a sports stadium or outside a theatre. In fact, in more towns, cities, and states every day, smokers can't even light up in a bar at which point, even to many non-smokers, the whole anti-smoking obsession reaches the point of absurdity. Cigarette smokers are on the defensive these days, and have to catch a street-corner smoke when they can smoke at all. And even then, there is the taint of tobacco smoke that clings to their breath and their clothes when they go back inside.

SUMMARY

The present invention is a cigarette storage system for holding at least one cigarette. The cigarette storage system comprises a case and an airtight storage formed in the case for holding the at least one cigarette. A lighter fluid reservoir is formed in the case with the lighter fluid reservoir having an amount of lighter fluid therein. A cigarette lighter fluidly cooperates with the lighter fluid in the lighter fluid reservoir with the cigarette lighter igniting the lighter fluid to produce a flame for lighting the at least one cigarette wherein a user can remove a cigarette from the airtight storage and ignite the cigarette with the cigarette lighter prior to smoking the cigarette.

In addition, the present invention includes a method for holding and smoking at least one cigarette. The method comprises providing a case, forming an airtight storage in the case, inserting at least one cigarette into the airtight storage, forming a lighter fluid reservoir in the case, filling the lighter fluid reservoir with an amount of lighter fluid, providing a cigarette lighter, fluidly cooperating the cigarette lighter with the lighter fluid in the lighter fluid reservoir, removing the at least one cigarette, lighting the at least one cigarette with the cigarette lighter, and smoking the cigarette.

The present invention further includes a cigarette storage system for holding at least one cigarette. The cigarette storage system comprises a case and an airtight storage formed in the case for holding the at least one cigarette. A lighter fluid reservoir is formed in the case with the lighter fluid reservoir having an amount of lighter fluid therein. A cigarette lighter fluidly cooperates with the lighter fluid in the lighter fluid reservoir with the cigarette lighter igniting the lighter fluid to produce a flame for lighting the at least one cigarette. A snuffer is formed on an outer surface of the case with the snuffer extinguishing the at least one cigarette after ignition of the cigarette. A locking compartment is formed in the case with the locking compartment sized and shaped for receiving gum or breath mints. A fragrance reservoir formed in the case and a spray dispenser communicates with the fragrance reservoir for distributing the fragrance wherein a user can remove a cigarette from the airtight storage and ignite the cigarette with the cigarette lighter prior to smoking the cigarette.

DETAILED DESCRIPTION OF THE PREFERRED EMBODIMENTS

Figures 1, 2:
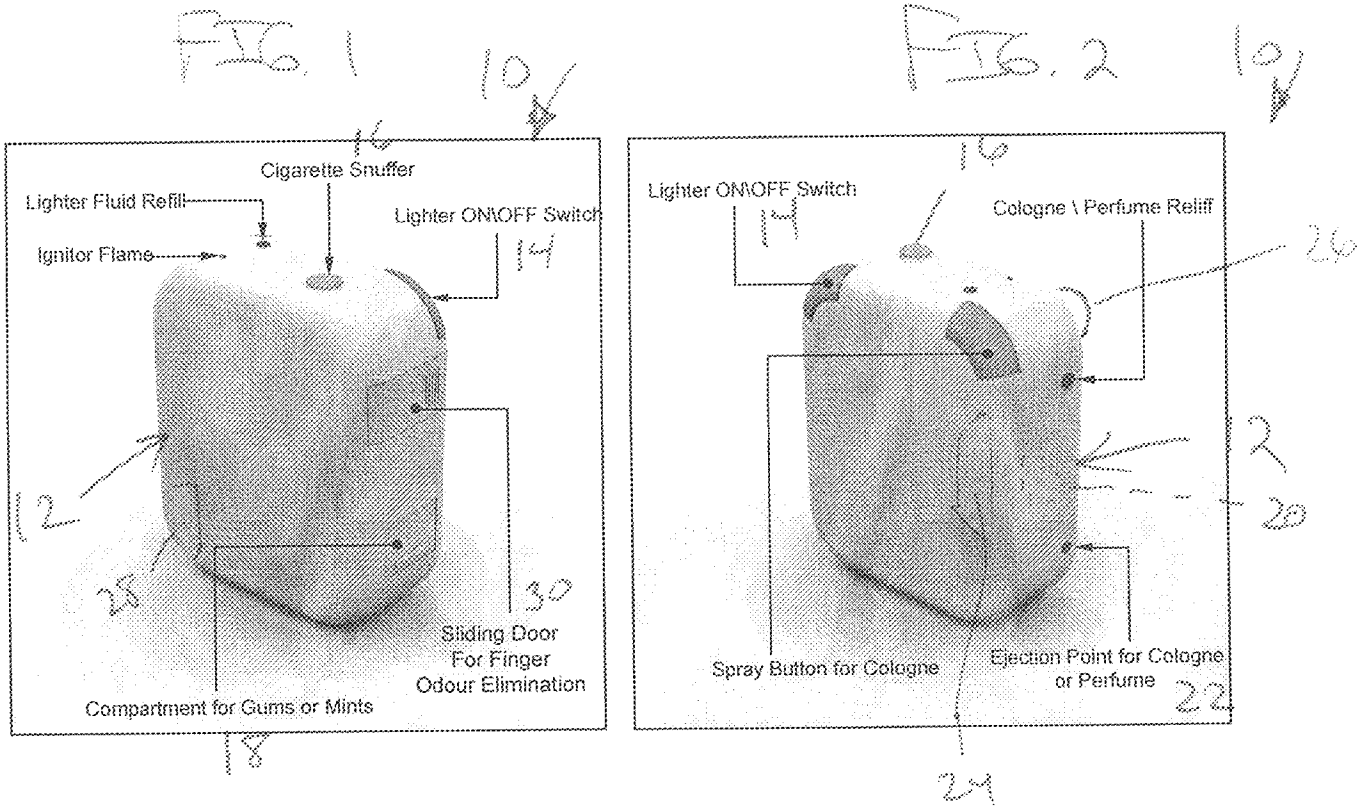
FIG. 1 is a front perspective view illustrating a cigarette storage system, constructed in accordance with the present invention.
FIG. 2 is a rear perspective view illustrating a cigarette storage system, constructed in accordance with the present invention.

As illustrated in FIGS. 1 and 2, the present invention is a cigarette storage system, indicated generally at 10, offering smokers a compact, convenient means of carrying everything required for a "step-out" smoke. The cigarette storage system 10 of the present invention is a self-contained, all-inclusive system for the on-the-go cigarette smoker providing a host of benefits and advantages in one stylish, compact package.

In sum, the cigarette storage system 10 of the present invention incorporates a case 12 providing an airtight storage for six or seven cigarettes, a cigarette lighter 14, a non-inflammable snuffer 16 mounted on an outer surface of the case 12 for extinguishing a lit cigarette, a releasably locking compartment 18 for gum or breath mints, and a reservoir 20 and spray dispenser 22 for perfume or cologne. The case 12 of the cigarette storage system 10 is preferably shaped as a cube, one and one-quarter (1¼") inches in height and width, although a rectangular design, about the length of a cigarette pack but considerably narrower, can also be constructed. The cigarette storage system 10 enables a smoker to: 1) open the airtight storage compartment 24 and extract one of the six or seven cigarettes stored there; 2) light that cigarette with the electronic lighter 14 or a traditional flint-and-fluid lighter; 3) snuff out or extinguish the smoke when completed; 4) open the gum/mint compartment 18 for a piece of gum or a breath mint; and 5) finish off with a puff of perfume or cologne from the built-in reservoir 20 and spray-dispenser 22. The case 12 of the cigarette storage system 10 features locking but easily removable fittings for accessing the perfume/cologne and lighter-fluid reservoirs, and screw-fittings that can be opened with the insertion and rotation of a dime or the like. A small metal piece 26 can be provided on the case to releasably attach the case to other articles, such as key rings, smaller "D" clamps, straps, belt loops, charms, bag handles, etc.

The case of the cigarette storage system 10 of the present invention further includes another airtight compartment 28 for the spent cigarette filter, as these are made from synthetic fibers, are litter, and can persist in the environment for many years. With the addition of a filter compartment 28, the case can also be effectively marketed as an environmentally responsible product and a little positive PR. Further, the case can also incorporate a snap-cover compartment 30 equipped with an odor-eliminating sponge with the user wiping his or her fingers, following a smoke, to eliminate the cigarette odor. Finally, the case 12 lends itself to production in a wide variety of materials and motifs, from injection-molded thermoplastic to fine silver, and embellishments ranging from simple printed patterns or graphic logos to embedded costume or genuine jewels. One such design alteration eliminates the cigarette-case from the case 12, resulting in a slimmer, more compact unit featuring a lighter, snuffer, perfume/cologne dispenser, and mint or gum holder. The case 12 will appeal strongly to heavier smokers, and to cigar smokers.

Designed to convey everything the smoker requires, i.e., cigarettes, a lighter, a snuffer, gum or breath mints, and even a puff of perfume or cologne for freshening up after a cigarette, the cigarette storage system 10 of the present invention eliminates the need to carry all of these items separately, and instead allows the smoker to carry them all in one attractive, functional package. Further, the basic design of the case can be altered to appeal to distinct markets, i.e., a masculine look for men, a feminine look for women, for example, and a variety of standard/premium/deluxe models incorporating different materials, motifs, and embellishments. Thus, the case can be individualized to appeal to a broad range of smokers, so that while the case remains a mass-produced article, it yet retains a sense of customized, individual styling. The utmost in convenience, the case fits easily in pocket or purse, be ready to go on a moment's notice, and require no time lost in looking for one's lighter, gum, or other essential supplies.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A cigarette storage system for holding at least one cigarette, the cigarette storage system comprising:

a case;

an airtight storage formed in the case for holding the at least one cigarette;

a lighter fluid reservoir formed in the case, the lighter fluid reservoir having an amount of lighter fluid therein;

a cigarette lighter fluidly cooperating with the lighter fluid in the lighter fluid reservoir, the cigarette lighter igniting the lighter fluid to produce a flame for lighting the at least one cigarette;

a recess formed in the case, the recess being sized and shaped for receiving at least a portion of a finger;

a sponge material positioned within the recess;

an odor eliminating substance in the sponge; and a cover closable over the recess, the cover providing an airtight seal of the recess;

wherein a user can remove a cigarette from the airtight storage and ignite the cigarette with the cigarette lighter prior to smoking the cigarette; and wherein upon contacting the sponge with the at least a portion of a finger, at least a portion of the odor eliminating substance is transferred from the sponge to the at least a portion of a finger.

2. The cigarette storage system of claim 1 and further comprising:

a snuffer formed on an outer surface of the case, the snuffer extinguishing the at least one cigarette after ignition of the cigarette.

3. The cigarette storage system of claim 1 and further comprising:

a locking compartment formed in the case, the locking compartment sized and shaped for receiving gum or breath mints.

4. The cigarette storage system of claim 1 and further comprising:

a fragrance reservoir formed in the case; and a spray dispenser communicating with the fragrance reservoir for distributing the fragrance.

5. The cigarette storage system of claim 1 wherein a shape of the case is selected from the group consisting of cube and rectangular.

6. The cigarette storage system of claim 1 and further comprising:

a metal ring secured to the case.

7. The cigarette storage system of claim 1 and further comprising:

a spent cigarette compartment formed in the case; and a lid for covering the spent cigarette compartment, the lid forming an airtight seal of the spent cigarette compartment.

8. A method for holding and smoking at least one cigarette, the method comprising:

providing a case;

forming an airtight storage in the case;

inserting at least one cigarette into the airtight storage;

forming a lighter fluid reservoir in the case;

filling the lighter fluid reservoir with an amount of lighter fluid;

providing a cigarette lighter;

fluidly cooperating the cigarette lighter with the lighter fluid in the lighter fluid reservoir;

forming a recess formed in the case;

sizing and shaping the recess for receiving at least a portion of a finger;

positioning a sponge material within the recess;

placing an odor eliminating substance in the sponge;

removing the at least one cigarette;

lighting the at least one cigarette with the cigarette lighter;

inserting a finger into the recess;

transferring at least a portion of the odor eliminating substance to the at least a portion of the finger;

closing a cover over the recess;

creating an airtight seal of the recess; and smoking the cigarette.

9. The method of claim 8 and further comprising:

forming a snuffer formed on an outer surface of the case; and extinguishing the at least one cigarette with the snuffer.

10. The method of claim 8 and further comprising:

forming a locking compartment formed in the case; and sizing and shaping the locking compartment for receiving gum or breath mints.

11. The method of claim 8 and further comprising:

forming a fragrance reservoir in the case;

providing a spray dispenser;

fluidly cooperating the spray dispenser with the fragrance reservoir; and distributing the fragrance through the spray dispenser.

12. The method of claim 8 and further comprising:

selecting a shape of the case from the group consisting of cube and rectangular.

13. The method of claim 8 and further comprising:

securing a metal ring to the case.

14. The method of claim 8 and further comprising:

forming a spent cigarette compartment in the case;

inserting a spent cigarette into the spent cigarette compartment;

covering the spent cigarette compartment; and forming an airtight seal of the spent cigarette compartment.

15. A cigarette storage system for holding at least one cigarette, the cigarette storage system comprising:

a case;

an airtight storage formed in the case for holding the at least one cigarette;

a lighter fluid reservoir formed in the case, the lighter fluid reservoir having an amount of lighter fluid therein;

a cigarette lighter fluidly cooperating with the lighter fluid in the lighter fluid reservoir, the cigarette lighter igniting the lighter fluid to produce a flame for lighting the at least one cigarette;

a snuffer formed on an outer surface of the case, the snuffer extinguishing the at least one cigarette after ignition of the cigarette;

a locking compartment formed in the case, the locking compartment sized and shaped for receiving gum or breath mints;

a fragrance reservoir formed in the case;

a spray dispenser communicating with the fragrance reservoir for distributing the fragrance;

a recess formed in the case, the recess being sized and shaped for receiving at least a portion of a finger;

a sponge material positioned within the recess;

an odor eliminating substance in the sponge; and a cover closable over the recess, the cover providing an airtight seal of the recess;

wherein a user can remove a cigarette from the airtight storage and ignite the cigarette with the cigarette lighter prior to smoking the cigarette; and wherein upon contacting the sponge with the at least a portion of a finger, at least a portion or the odor eliminating substance is transferred from the sponge to the at least a portion of a finger.

16. The cigarette storage system of claim 15 and further comprising:

a spent cigarette compartment formed in the case; and a lid for covering the spent cigarette compartment, the lid forming an airtight seal of the spent cigarette compartment.

17. The cigarette storage system of claim 16 wherein each storage, compartment, lid, and cover has lockable, screw fittings for access and openable with the insertion and rotation of a dime or the like.

* * * * *